United States Patent [101]

Komatsu

[11] 4,046,099

[45] Sept. 6, 1977

[54] APPARATUS FOR SIZING A YARN SHEET

[75] Inventor: Tokuji Komatsu, Kanazawa, Japan

[73] Assignee: Tsudakoma Kogyo Kabushiki Kaisha, Japan

[21] Appl. No.: 631,730

[22] Filed: Nov. 13, 1975

[30] Foreign Application Priority Data

May 16, 1975 Japan ..... 50-64392

[51] Int. Cl.[2] ..... B05C 1/08

[52] U.S. Cl. ..... 118/6; 118/7; 118/117; 118/246; 118/247; 68/203

[58] Field of Search ..... 118/246, 117, 6, 7, 118/9, 247; 68/202, 203; 28/28

[56] References Cited

U.S. PATENT DOCUMENTS

| | | | |
|---|---|---|---|
| 1,350,789 | 8/1920 | Delany et al. | 118/246 |
| 2,637,659 | 5/1953 | Miller | 68/202 X |
| 2,977,662 | 4/1961 | Freeze et al. | 118/117 X |
| 3,871,196 | 3/1975 | Matsunaga | 68/203 |

*Primary Examiner*—John P. McIntosh

*Attorney, Agent, or Firm*—Burgess, Ryan and Wayne

[57] ABSTRACT

Sizing of a yarn sheet is practiced without direct immersion into a size bath through running pressure contact of same with a rotary sizing roller while the process is so automatically controlled that, at starting of the sizing operation, the drive for running of the yarn sheet starts after all the related working elements are registered at their operative positions and, at stopping of the operation, the elements are released from the registered operative positions after the yarn sheet has come to a complete stop.

12 Claims, 7 Drawing Figures

Fig. 5
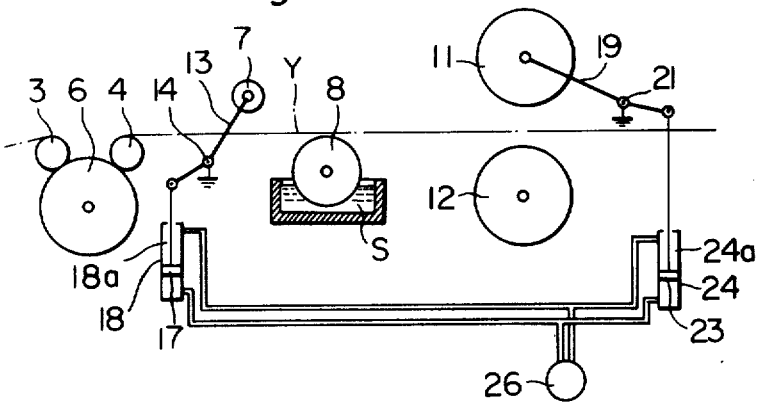
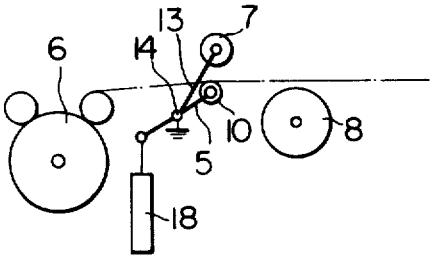
Fig. 6
Fig. 7
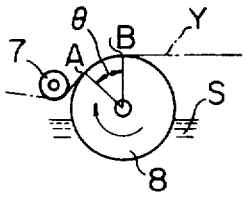

APPARATUS FOR SIZING A YARN SHEET

BACKGROUND OF THE INVENTION

The present invention relates to apparatus for sizing a yarn sheet, more particularly relates to method and apparatus for sizing a yarn sheet such as warp sheet in an automatically controlled manner without direct immersion of same into a size bath.

In most of the conventional sizing systems, it is quite customary to force the running sheet to be immersed in and travel through a size bath in order to coat the yarn sheet fully with the size. This full immersion of the yarns in the size bath inevitably causes excessive adsorption of watery component of the bath by the yarns composing the sheet. This excessive adsorption of water in the sizing process, which is especially outstanding especially when low concentrated size is used, is very inadvantageous in the later staged drying process of the yarn sheet. Increased adsorption of water in the sizing process naturally connects to lowered efficiency in the drying process, the low drying efficiency forming a fatal bar to high speed running of the machine, i.e. escalation of the total process efficiency. In order to overcome this difficulty, it may be employable either to raise the effective temperature in the drying chamber and/or to elongate the travelling distance of the yarn sheet through the drying chamber.

However, in accordance with the kind of the yarn composing the sheet, there may be some definite limit to the temperature of the yarn during the drying process. One must be very careful in control of the yarn temperature during the drying process especially when any synthetic material or materials are used for the yarns composing the sheet. Thus, in some situations, it is quite difficult or almost impossible to adopt the first measure in order to overcome the above-mentioned difficulty.

The second measure inevitably requires enlargement of the equipment construction and/or the floor space for the equipment. This causes undesirable increase in the plant and equipment investment.

It is the primary object of the present invention to provide apparatus for sizing a yarn sheet which is quite free of the ill influence on the drying process to be caused by excessive water adsorption in the sizing process.

The direct immersion of the yarn sheet in the size bath brings about a further drawback. When the yarn sheet runs through the size bath especially at a high speed, the size bath is stirred by the running yarn sheet itself in addition to the stirring by the rotation of the immersion roller and such stirring develops numerous bubbles in and on the size bath. As is well known, bubbles so developed tend to give ill influence upon the quality of the yarn sheet processed. This also sets a limit to the running speed of the yarn sheet and, accordingly, to the total efficiency in the yarn processing.

It is another object of the present invention to provide method and apparatus for sizing a yarn sheet which is free of ill influence by develop must of bubbles in and on the size bath.

In order to carry out sizing process smoothly, it is preferable that the yarn sheet starts to run through the equipment after all the related work element has been registered at their operative positions and the elements are kept at their registered operative position even during the running of the yarn sheet by inertia after the drive for the yarn sheet is turned off. In addition, it is preferable that the yarn sheet is kept free of contact with the size and free of pressure nip for squeezing purpose. Otherwise, unevenness in the sizing effect on the yarn sheet along the length shall be caused and, an is well known, such uneven sizing effect often cause troubles in the subsequent processes such as the weaving process.

It is the other object of the present invention to provide apparatus for sizing a yarn sheet in a well organized fully automatic fashion in which operations of the work elements taking part in the sizing are controlled in regular sequence.

BRIEF DESCRIPTION OF THE INVENTION

The above-described objects are attained by the sizing system in accordance with the present invention, in which a yarn sheet is delivered from a given supply source by, for example, a rotary feed roller and placed, firstly, in pressure contact with a running curved surface at a prescribed angle of contact, the curved surface being typically given in the form of the peripheral surface of a rotary sizing roller whose lower part is placed under the size bath level. The angle of contact is set by a contact roller coacting with the sizing roller. After the sizing is over, squeezing is applied to the yarn sheet by a pair of coacting surfaces typically given by an upper squeezing and a bottom roller in pressure surface contact to each other.

In accordance with a preferred embodiment of the present invention, operations of the work elements involved in the sizing in collectively and electrically controlled by an automatic control device in regular sequence in such a manner that, at starting of the sizing operation, registration of the work elements at their operative positions precedes starting of the drive for running of the yarn sheet whereas, at the stopping of the sizing operation, release of the elements from their registered positions succeeds cancellation of the drive for running of the yarn sheet.

BRIEF DESCRIPTION OF THE DRAWINGS

Further features and advantages of the present invention will be made clearer from the ensuing description, reference being made to the accompanying drawings, in which;

FIG. 5 is an explanatory schematic side plan view, partly omitted, of the apparatus shown in FIG. 1 in the inoperative disposition, FIG. 6 is an explanatory schematic side plan view of the main part of another embodiment of the apparatus in accordance with the present invention and FIG. 7 is a schematic side plan view for explaining the angle of contact of the yarn sheet with the sizing roller.

DETAILED DESCRIPTION OF THE INVENTION

Figure 1:
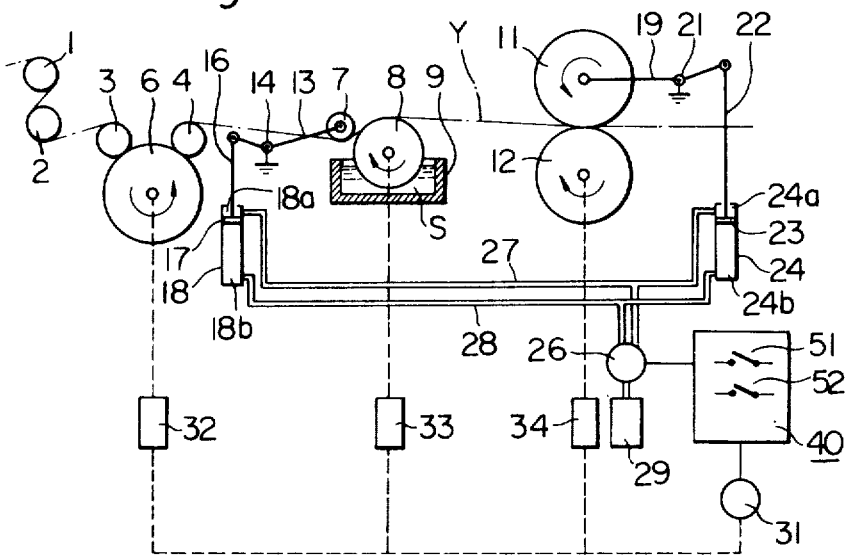
FIG. 1 is an explanatory schematic side plan view of an embodiment of the apparatus in accordance with the present invention in the disposition during sizing.

An embodiment of the apparatus in accordance with the present invention is shown in FIG. 1, in which the apparatus is provided, from the upstream side along the running couse of the yarn sheet Y, with a number of rotary guide rollers 1 through 4, a rotary feed roller 6 in pressure surface contact with the last two guide rollers 3 and 4, a rotary contact roller 7, a rotary sizing roller 8 arranged partly in a size box 9, a top rotary sgueezing roller 11, a bottom roller 12 cooperating with the squeezing roller 11 when they are in pressure surface contact with each other and known drying and taking up machanisms (not shown) for the yarn sheet Y.

The contact roller 7 is rotatably carried by one end of a lever 13 which is pivoted, at about the midway of its length, at a fixed support 14 on the machine framework. The other end of the lever 13 is pin joined to one end of a piston rod 16, the other end of which is linked to a piston 17 in a fluid aspirating cylinder 18 such as a pneumatic cylinder.

In a similar manner, the squeezing roller 11 is rotatably carried by one end of a lever 19 which is pivoted, at about the midway of its length, at a fixed support 21 on the machine framework. The other end of the lever 19 is pin joined to one end of a piston rod 22, the other end of which is linked to a piston 23 in a fluid operating cylinder 24 of a type similar to the cylinder 18 for the contact roller 7.

The both cylinders 18 and 24 are connected to an electromagnetic check valve 26 via pipings 27 and 28 in such a manner that one piping 27 communicates with chambers **18*a* and 24*a* of the respective cylinders on the upper sides of the pistons 17 and 23 whereas the other piping communicates with chambers 18*b* and 24*b* of the respective cylinders on the lower sides of the pistons 17 and 23. The check valve 26 is coupled to a supply source 29** of the pressured fluid such as an air compressor.

Thus, when the one piping 27 is joined to the supply source 29 by switching action of the check valve 26, the pressured fluid is supplied into the upper chambers **18*a* and 24*a* of the cylinders 18 and 24, the pistons 17 and 23 are pushed down and, via the respective piston rods 16 and 22, the levers 13 and 19 are so turned about the associated supports 14 and 21 as to lift the rollers 7 and 11 as shown in FIG. 5. Concurrently with this procedure, the check valve 26 so operates as to join the other piping 28 to a suitable drain (not shown). Thus, the pressured fluid in the lower chambers 18*b* and 24*b* of the cylinders 18 and 24 is duly discharged in order to assist the lowering of the pistons 17 and 23**.

On the contrary, when the other piping 28 is joined to the supply source 29 and the one piping 27 is joined to the given drain by switching action of the check valve 26, the pressured fluid is supplied into the lower chambers **18*b* and 24*b* of the cylinders 18 and 24, the pistons 17 and 23 are pushed up and, via the respective piston rods 16 and 22, the levers 13 and 19 are so turned about the associated supports 14 and 21 as to lower the rollers 7 and 11 as shown in FIG. 1**.

Figure 2:
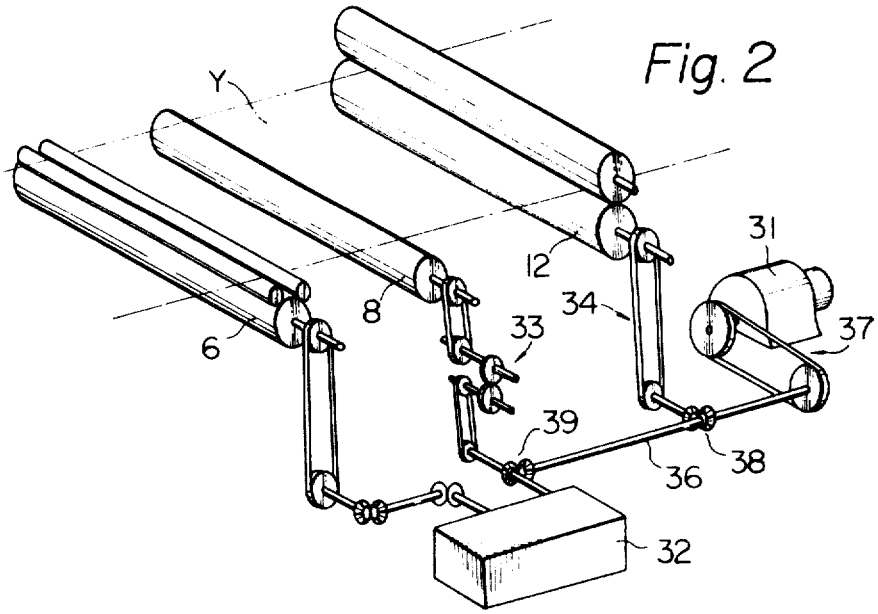
FIG. 2 is an explanatory perspective plan view of the driving system used for the apparatus shown in FIG. 1.

As shown with dashed lines, the feed roller 6 is connected to a drive motor 31 via a change gear box 32, the sizing roller 8 to the motor 31 via a gear train 33 and the bottom roller 12 to the motor 31 via a power transmission 34. This mechanical driving system for rotation of the roller 6, 8 and 12 is shown further in detail in FIG. 2. As is clear in the drawing, rotation of the drive motor 31 is transmitted to a main drive shaft 36 via a belt or chain transmission 37 and the corresponding rotation of the main drive shaft 36 is transmitted to the bottom roller 12 via bevel gears 38 and the power transmission 34, to the sizing roller 8 via bevel gears 39 and the gear train 33 and to the feed roller 6 via the bevel gears 39 and the change gear box 32.

Figure 3:
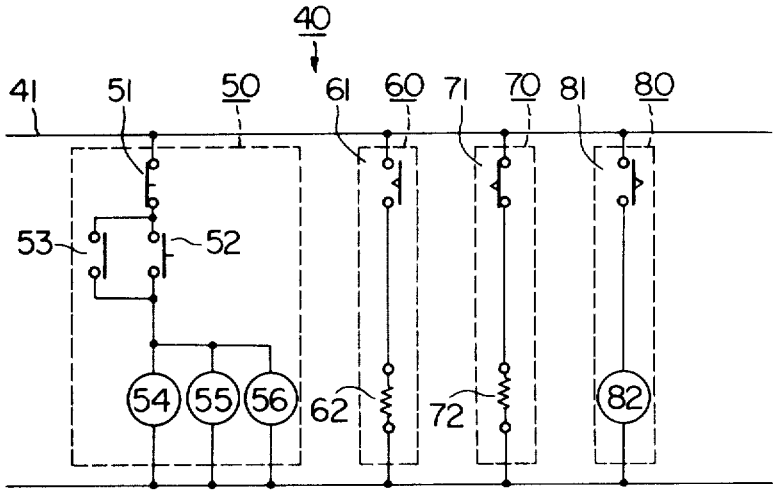
FIG. 3 is a circuit diagram of the control system used for the apparatus shown in FIG. 1.

Time sequential control of the switching of the check valve 26 and the drive motor 31 is carried out by an automatic control device 40 electrically connected to these elements. The detail construction of the control device 40 and its related elements is shown in FIG. 3, in which a machine starting and stopping circuit 50, a rollers lowering circuit 60, a rollers lowering circuit 70 and a drive motor actuating circuit 80 are inserted, in parallel to each other, between a pair of output lines 41 and 42 of a given electric source (not shown).

The machine starting and stopping circuit 50 includes a stopping switch 51 given in the form of a self-return contact coupled to the one input line 41 at one terminal thereof, the first sub-circuit coupled, at one terminal thereof, to the other terminal of the stopping switch 51 and including, in parallel to each other, a machine starting switch 52 given in the form of a self-return contact and a relay a-contact 53, and the second sub-circuit coupled, at one terminal thereof, to the other terminal of the first sub-circuit and, at the other terminal thereof, to the other output line 42 of the electric source. This second sub-circuit includes three sets of relays 54, 55 and 56 in parallel to each other. The term a-contact denotes a normally open contact while b-contact denotes a normally closed contact.

The rollers lowering circuit 60 includes a relay a-contact 61 of a time-limit-return type connected, at one terminal thereof, to the output line 41 and the first solenoid 62 for the electro-magnetic check valve 26 in FIG. 1, which is coupled, at one terminal thereof, to the other terminal of the relay a-contact 61 and, at the other terminal thereof, to the output line 42 of the electric source.

The rollers lifting circuit 70 includes a relay b-contact 71 of a time-limit-return type coupled, at one terminal thereof, to the output line 41 and the second solenoid 72 for the electro-magnetic check valve 26 in FIG. 1, which is coupled, at one terminal thereof, to the other terminal of the relay b-contact 71 and, at the other terminal thereof, to the output line 42.

The drive motor actuating circuit 80 includes a relay a-contact 81 of a time-limit-acting type coupled, at one terminal thereof, to the output line 41 and an electromagnetic contact 82 for the drive motor 31 in FIG. 1, which is coupled, at one terminal thereof, to the other terminal of the relay a-contact 81 and, at the other terminal thereof, to the output line 42.

In the above-described construction of the automatic control device 40, relationship between the circuit elements is summerized as follows;

The relay a-contact 53 in the circuit 50 is the relay a-contact of the relay 54 in the same circuit.

The relay a-contact 61 (time-limit-return type) in the circuit 60 is the relay a-contact of the relay 55 in the circuit 50.

The relay b-contact 71 (time-limit-return type) in the circuit 70 is the relay b-contact of the relay 55 in the circuit 50.

The relay a-contact 81 (time-limit-acting type) in the circuit 80 is the relay a-contact of the relay 56 in the circuit 50.

When the first solenoid 62 in the circuit 60 is energized, it switches the check valve 26 so that the pressured fluid is supplied, via the piping 28, into the lower chambers **18*b* and 24*b* of the cylinders 18 and 24, the pressured fluid in the upper chambers 18***a* and 24*a* is discharged via the piping 27, the pistons 17 and 23 are pushed up and the rollers 7 and 11 lower towards their associated rollers 8 and 12, respectively.

When the second solenoid 72 in the circuit 70 is energized, it switches the check valve 26 so that the pressured fluid is supplied, via the piping 27, into the upper chambers 18*a* and 24*a* of the cylinders 18 and 24, the pressured fluid in the lower chambers 18*b* and 24*b* is discharged via the piping 28, the pistons 17 and 23 are pushed down and the rollers 7 and 11 are lifted away from their associated rollers 8 and 12, respectively.

The apparatus of the present invention having the abovedescribed construction operates in the following manner.

1. Starting of the machine

When the operator depresses the starting switch 52 at time $t = 0$, the machine starting and stopping circuit 50 is closed and the relay 54 so operates as to close the relay a-contact 53 in order to hold the closed state of the circuit 50. (see FIGS. 3 and 4) Concurrently with this, the relays 55 and 56 come into operation to close the relay a-contact 61 in the circuit 60 and open the relay b-contact 71 in the circuit 70. The relay a-contact 81 of the circuit 80 is closed at a prescribed time $t = t_1$. Therefore, the roller lowering circuit 60 is put into a closed state and the rollers lifting circuit 70 into an open state at the time $t = 0$.

Upon energization of the first solenoid 62 in the circuit 60 in the closed state, it switches the check valve 26 in FIG. 1 so that the pressured fluid is supplied into the lower chambers 18*b* and 24*b* and the pistons 17 and 23 are pushed up. By this upward movement of the pistons 17 and 23, the rollers 7 and 11 start to lower towards their associated rollers 8 and 12. As the contact roller 7 approaches the sizing roller 8, the yarn sheet Y is urged to move downwardly and comes into contact with the periphery of the sizing roller 8. Concurrently, the lowering squeezing roller 11 forces the yarn sheet Y to move downwardly towards the periphery of the bottom roller 12.

Figure 4:
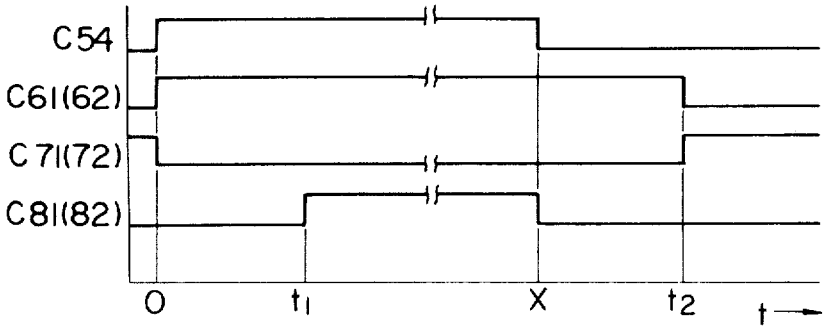
FIG. 4 is a graphical drawing for explaining time sequential operation of the control system shown in FIG. 3.

In FIG. 4, a curve C54 is for the relay 54 in the circuit 50, a curve C61(62) is for the relay a-contact 61 and the first solenoid 62 in the circuit 60, a curve C71(72) is for the relay b-contact 71 and the second solenoid 72 in the circuit 70 and a curve C81(82) is for the relay a-contact 81 and the electro-magnetic contact 82 in the circuit 80.

At the prescribed time $t = t_1$, lowering of the rollers 7 and 11 ceases. In this disposition, the yarn sheet Y is in contact with the periphery of the sizing roller at a prescribed angle of contact $\theta$. As shown in FIG. 7, the angle of contact $\theta$ refers to the center angle of a sector defined by a point A whereat the yarn sheet Y comes into contact with the periphery of the sizing roller 8, a point B whereat the yarn sheet Y leaves the periphery of the sizing roller 8 and the axis of the roller 8. It will be well understood that the more is the lowering of the contact roller 7, the larger is the value of the angle of contact $\theta$.

The lower part of the sizing roller 8 is partly immersed in the size S and, as the sizing roller 8 rotates in the direction of an arrow in the drawing, some amount of the size S is brought upwards towards the yarn sheet Y while sticking to the periphery of the roller 8. The part of the size S so brought up comes in contact with the yarn sheet Y at the point A and partly passed to the yarn sheet Y during the travel thereof over the distance between the points A and B. The part of the size S not passed to the yarn sheet Y is returned to the bath in the size box 9.

It should be noted also that the larger is the value of the angle of contact $\theta$, the larger and the evener is the sizing effect of the yarn sheet provided that the normal running speed of the yarn sheet be kept unchanged. On the downstream side, the yarn sheet Y is nipped between the squeezing roller 11 and the bottom roller 12.

At this prescribed time $t = t_1$, the relay a-contact 81 is closed, the electro-magnetic contact 82 is closed and the drive motor 31 in FIG. 1 starts its rotation. This rotation is transmitted to the rollers 6, 8 and 12 as already described and the rollers 6, 8 11 and 12 start to rotate as shown with arrows in FIG. 1. Thus, the yarn sheet Y is delivered from a given supply source (not shown) by the feed roller 6, sized by the sizing roller 8, squeezed by the squeezing and bottom rollers 11 and 12 and passed to the downstream drying mechanism (not shown).

2. Stopping of the machine

When the machine is to be stopped at a time $t = X$, the stopping switch 51 is depressed by the operator. By this depression of the switch 51, the machine starting and stopping circuit 50 is made open momentarily and the relay a-contact 53 in is made open so that the open state of the circuit 50 is held. Therefore, the relay a-contact 81 in the drive motor actuating circuit 80 is made open, too. After a prescribed time delay, the relay a-contact 61 of the rollers lowering circuit 60 is made open and the relay b-contact 71 is again closed at a time $t = t_2$.

Thus, as a result of opening of the relay a-contact 81, the electro-magnetic contact 80 for the drive motor 31 is made open and the drive motor 31 carries on inertia rotation until a time before the time $t = t_2$. As the inertia rotation of the drive motor 31 is completed, running of the yarn sheet Y ends completely.

At the time $t = t_2$, the relay a-contact 61 in the roller lowering circuit 60 is made open so that the circuit 60 is made inoperative whereas the relay b-contact 71 in the roller lifting circuit 70 is closed so that the circuit 70 is made operative. Thus, the second solenoid 72 in the circuit 70 so switches the check valve 26 in FIG. 1 that the pressured fluid is supplied into the upper chambers 18*a* and 24*a* and the pistons 17 and 23 are pushed down. By this downward movement of the pistons 17 and 23, the levers 13 and 19 are so turned about their supports 14 and 21 as to make the rollers 7 and 11 start to move upwardly away from their associated rollers 8 and 12, respectively.

As the contact roller 7 arrives at its normal stand-by position shown in FIG. 5, the yarn sheet Y is released from its contact with the periphery of the sizing roller 8. Similarly, as the squeezing roller 11 assumes its normal stand-by position shown in FIG. 5, the yarn sheet Y is released from the nip by the two rollers 11 and 12.

A modified embodiment of the apparatus of the present invention is shown in FIG. 6, in which the lever 13 for the contact roller 7 is accompanied with a branch 5 formed in one body therewith. This branch 5 carries at its free end a freely rotatable roller 10 which positions somewhat under the contact roller 7. When the contact roller 7 is lifted away from the sizing roller 8 as shown in the drawing, this roller 10 moves upwardly also and urges the yarn sheet Y from the downside to move upwardly. In other words, the roller 10 assists the separation of the yarn sheet Y from the periphery of the sizing roller 8. By the presence of this additional roller 10, the yarn sheet Y can always be separated from the sizing roller 8 without any failure.

As is well understood from the foregoing description, the following advantages are resulted from employment of the present invention.

a. As the sizing of the yarn sheet Y is carried out by the running contact of same with the rotary sizing roller 8 and the yarn sheet 8 itself is not immersed in the size bath, no unnecessarily excessive adsorption of watery component by the yarns is caused. This is very advantageous in the later staged drying process of the yarn sheet especially when low concentrated size is used. Reduced adsorption of water in the sizing process connects to enhanced efficiency in the drying process.

b. As the yarn sheet Y is not immersed in the size bath, stirring of the size bath and development of bubbles in and on the size, which are often the case when the machine running speed is high, have substantially no ill influence upon the quality of the yarn sheet processed.

c. Reduced adsorption of water in the sizing process makes the next staged squeezing operation very easier.

d. At starting of the sizing operation, by a simple switching action by the operator only, the rollers 7 and 11 quite automatically assume the prescribed postures necessary for successful sizing and squeezing and running of the yarn sheet Y starts after this preparation is completed. In other words, running of the yarn sheet Y is initiated always after the related machine parts have assumed correct dispositions suited for successful sizing operation. This sequential operation control is practiced quite automatically.

e. At stopping of the sizing operation, by a simple switching action by the operator only, electric power supply to the drive motor is stopped but the rollers 7 and 11 carry on their normal operative disposition as far as inertia rotation of the motor goes on. After the inertia rotation of the motor is completed, the rollers 7 and 11 are made to assume their stand-by postures. Thus, correct sizing and squeezing operations can be applied to the part of the processed yarn sheet which is driven for running by the inertia rotation of the drive motor. This sequential operation is practiced quite automatically, also.

I claim:

1. Apparatus for sizing a yarn sheet comprising, in combination, a rotary feed roller of said yarn sheet a size bath, a rotary sizing roller partly immersed in said size bath, first means for placing said yarn sheet in pressure contact with said sizing roller in the area not immersed in said size bath, a rotary squeeze roller for forming a nip for said yarn sheet in cooperation with a bottom roller, second means for placing said squeeze roller in pressure contact with said bottom roller, a drive motor mechanically coupled to said feed, sizing and bottom rollers, means for simultaneously actuating operations of said first and second placing means, and an automatic control device electrically coupled to said drive motor and said actuating means and provided with stopping and starting switches, said control device comprising means operating immediately in response to actuation of said starting switch for operating said actuating means, and for initiating the operation of said drive motor following a predetermined time after actuation of said starting switch and for removing power from said drive motor immediately upon actuation of said stopping switch and for reversing the operation of said actuating means following a second predetermined time after actuation of said stopping switch, said second predetermined time being sufficient to insure that inertia running of said yarn sheet has come to a complete stop.

2. Apparatus as claimed in claim 1 in which said actuating means includes a first piston cylinder connected to said first placing means, a second piston cylinder connected to said second placing means, a pressure fluid supply source, an electro-magnetic check valve connected to said pressure fluid supply source and electrically coupled to said automatic control device, a first piping connecting said check valve to the upper chambers of said piston cylinders and a second piping connecting said check valve to the lower chambers of said piston cylinders.

3. Apparatus as claimed in claim 1 in which said automatic control device includes a machine starting and stopping circuit including said stopping and starting switches; said actuating means comprising a roller lowering circuit, a roller lifting circuit; and a drive motor actuating circuit, all of said circuits being connected in parallel to each other, between a pair of output lines coupled to a given electric power source.

4. Apparatus as claimed in claim 3 in which said machine stopping and starting circuit includes a first sub-circuit coupled at one terminal thereof to one of said output lines and comprising first, second and third relays arranged in parallel to each other, a second sub-circuit coupled at one terminal thereof to the other terminal of said first sub-circuit and comprising a relay a-contact of said first relay, and said starting switch arranged in parallel to each other, and said stopping switch coupled at one terminal thereof to the other terminal of said second sub-circuit and at the other terminal thereof to the other of said output lines.

5. Apparatus as claimed in claim 4 in which said stopping switch is of a self-return type.

6. Apparatus as claimed in claim 4 in which said starting switch is of a self-return type.

7. Apparatus as claimed in claim 4 in which said roller lowering circuit includes a relay a-contact of said second relay and a first solenoid for said actuating means, both being coupled in series to each other.

8. Apparatus as claimed in claim 7 in which said relay a-contact is of a time-limit-return type.

9. Apparatus as claimed in claim 4 in which said roller lifting circuit includes a relay b-contact of said second relay and a second solenoid for said actuating means, both being coupled in series to each other.

10. Apparatus as claimed in claim 9 in which said relay b-contact is of a time-limit-return type.

11. Apparatus as claimed in claim 4 in which said drive motor actuating circuit includes a relay a-contact of said third relay and an electro-magnetic contact for said drive motor, both being coupled in series to each other.

12. Apparatus as claimed in claim 11 in which said relay a-contact is of a time-limit-acting type.

* * * * *